US006186065B1

(12) United States Patent
Kersch et al.

(10) Patent No.: US 6,186,065 B1
(45) Date of Patent: Feb. 13, 2001

(54) CYLINDER IN A ROTARY PRINTING MACHINE

(75) Inventors: Robert Kersch, Dasing; Josef Göttling, Friedberg, both of (DE)

(73) Assignee: MAN Roland Durckmaschinen AG, Offenbach am Main (DE)

( * ) Notice: Under 35 U.S.C. 154(b), the term of this patent shall be extended for 0 days.

(21) Appl. No.: 09/421,686

(22) Filed: Oct. 20, 1999

(30) Foreign Application Priority Data

Oct. 20, 1998 (DE) ..... 198 48 184

(51) Int. Cl.[7] ..... B41F 5/00
(52) U.S. Cl. ..... 101/216; 101/212
(58) Field of Search ..... 101/216, 212, 101/375, 217, 218

(56) References Cited

U.S. PATENT DOCUMENTS

| | | | | |
|---|---|---|---|---|
| 2,925,037 | | 2/1960 | Fischer | 101/216 |
| 4,901,641 | * | 2/1990 | Steiner et al. | 101/216 |
| 4,913,048 | * | 4/1990 | Tittgemeyer | 101/375 |
| 5,241,905 | * | 9/1993 | Guaraldi et al. | 101/375 |
| 5,711,221 | * | 1/1998 | Comera et al. | 101/375 |
| 5,802,975 | * | 9/1998 | Prem et al. | 101/375 |
| 5,832,821 | * | 10/1999 | Petersen et al. | 101/375 |
| 5,960,714 | * | 10/1999 | Gottling et al. | 101/216 |

FOREIGN PATENT DOCUMENTS

| | | |
|---|---|---|
| 355111 | 6/1922 | (DE) . |
| 737 496 | 7/1943 | (DE) . |
| 1275904 | 12/1960 | (DE) . |

* cited by examiner

*Primary Examiner*—John S. Hilten
*Assistant Examiner*—Anthony H. Nguyen
(74) *Attorney, Agent, or Firm*—Cohen, Pontani, Lieberman & Pavane

(57) ABSTRACT

In order to expose a cylinder mounted at both sides in side walls on its side opposite its drive, a structural unit can be moved away from the cylinder at a separation point thereof. The cylinder is driven and a jamming device is attached to a screwed element which screws the structural unit to the cylinder.

11 Claims, 5 Drawing Sheets

CYLINDER IN A ROTARY PRINTING MACHINE

BACKGROUND OF THE INVENTION

1. Field of the Invention

The invention relates to cylinders in a rotary printing machine, and more particularly to plate or transfer cylinders in rotary printing machines.

2. Description of the Related Art

U.S. Pat. No. 2,925,037 shows a gravure plate cylinder which is mounted on both sides in side walls and, together with an inking mechanism, can be moved out of the frame through an opening in a side wall. The opening in the side wall is created by a mounting being drawn off the journal and pivoted away together with a portion of the wall. The mounting is seated with a conical sleeve on an external cone of the journal and is screwed to the latter by means of a screwed element. In order to pull off the mounting, it is first necessary for the screwed element to be manually detached by means of a tool. Conversely, following the introduction of the plate cylinder into the machine frame, the mounting has to be screwed to the journal manually.

SUMMARY OF THE INVENTION

It is an object of the invention to provide a cylinder in which the manual installation effort relating to exposing one of its sides is reduced.

This and other objects are achieved in accordance with an embodiment of the invention, where the drive motion of the cylinder is used to screw in or to detach a screwed element by means of which a structural unit can be screwed to the cylinder. During the screwing operation, a jamming device firmly holds the screwed element. As a result, a structural unit can be screwed onto or off the cylinder without the requiring tools and manual effort. In addition, the cylinder can be exposed quickly on one side.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is to be explained in more detail below using some exemplary embodiments. In the associated drawings.

DETAILED DESCRIPTION OF THE PRESENTLY PREFERRED EMBODIMENTS

Figure 1:
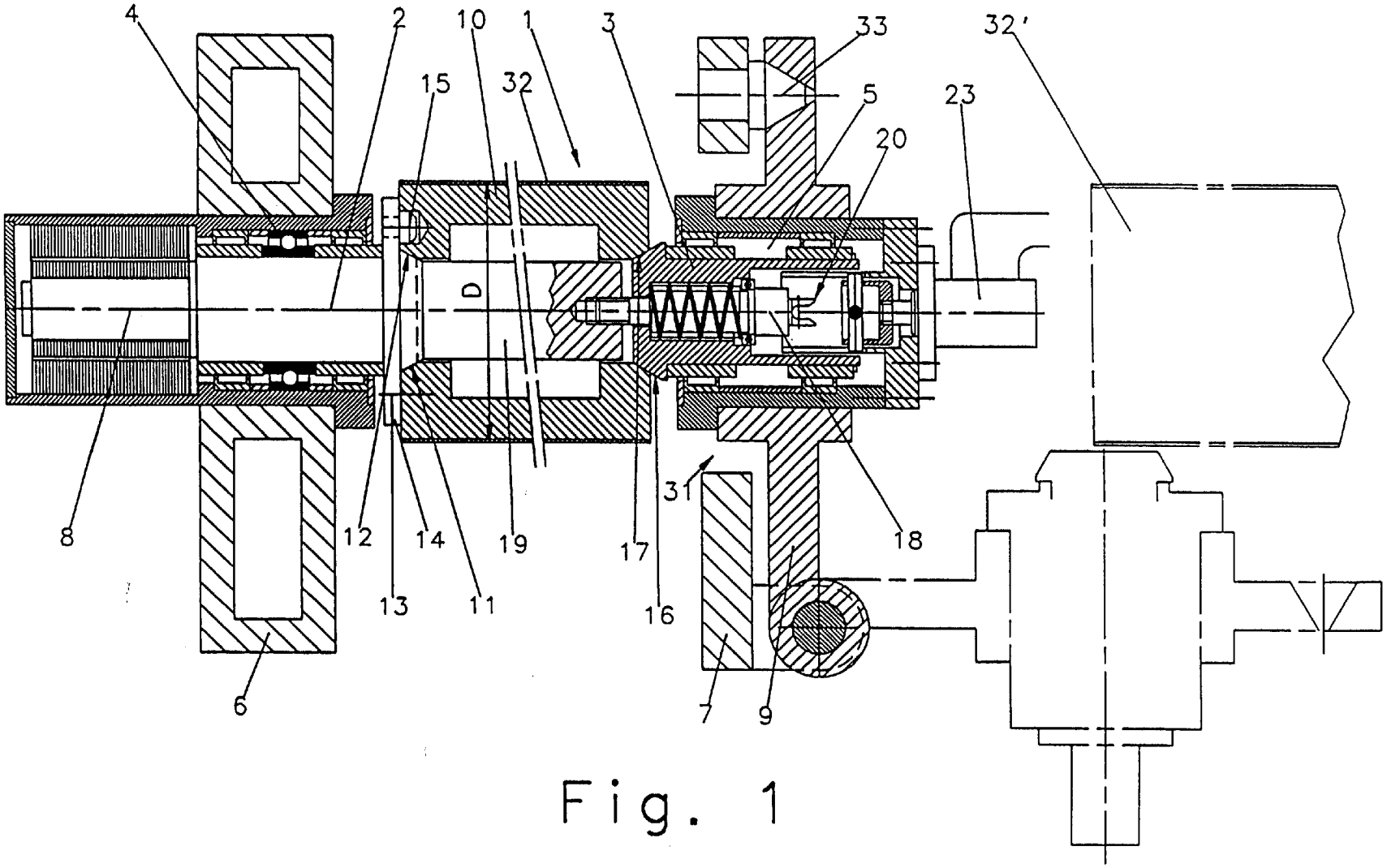
FIG. 1 is a sectional view of a cylinder with its own drive motor and a journal which can be pivoted out together with a portion of the wall.

FIG. 1 shows a cylinder 1, which is mounted with its journals 2, 3 in side walls 6, 7 by means of mountings 4, 5.

A motor 8 is arranged on the first journal 2. The second journal 3, together with its mounting 5, is accommodated in a portion 9 of a wall, this portion being fixed to the associated side wall 7 such that it can pivot.

The cylinder 1 contains a body 10 which is flange-mounted on the first journal 2. In this case, the fitting is carried out by means of a pair of cones, with an external cone 11 on the first journal 2 and an internal cone 12 on the body 10. Furthermore, the body 10 is screwed to the flange 14 by means of screws 13. This screw fixing may also be dispensed with if a force-transmitting connection between the first journal 2 and the body 10 is ensured by sufficient pre-stressing of the pair of cones. This connection can also be made in a positive manner by means of a protrusion 15.

The second journal 3 is detachably connected to the cylinder 1, with the separation point being designed as a pair of cones with an external cone 16 on the second journal 3 and an internal cone 17 on the body 10 of the cylinder 1. The external and internal cones 16 and 17 could also be assigned to the components in the opposite way. The second journal 3 is screwed to the cylinder 1 by means of a screwed element 18, while pairing the external and internal cones 16 and 17 on the cylinder 1. Since the body 10 of the cylinder 1 can be separated from the first journal 2, the screwed element 18 is screwed into the extension 19 of the first journal 2.

Figure 2:
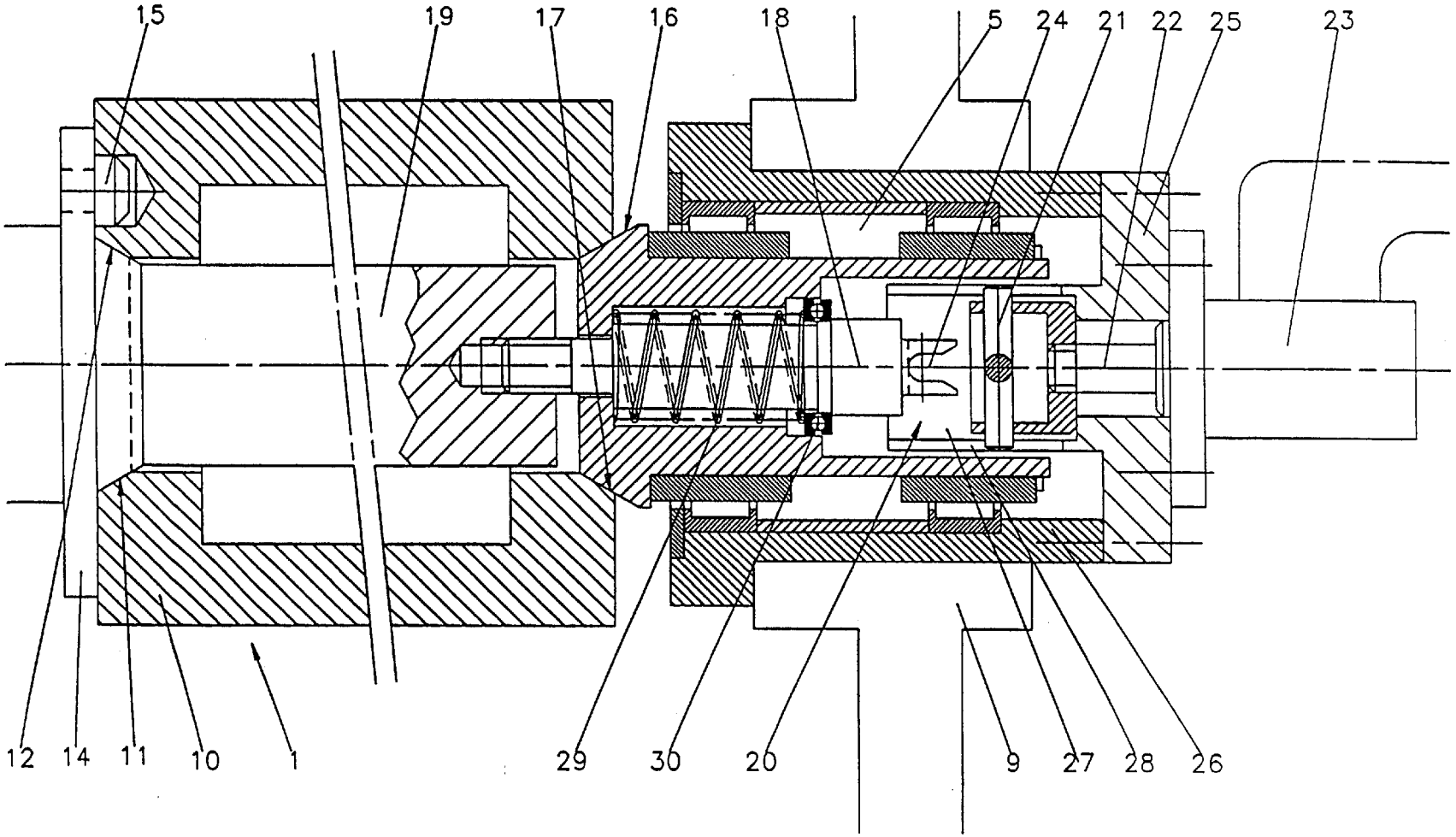
FIG. 2 is an enlarged sectional view of the pivotable journal depicted in FIG. 1.

A jamming device 20 is arranged on the second journal 3, and contains a claw coupling. A first non-rotatable coupling part 21 of jamming device 20 is fixed to a piston rod 22 (FIG. 2) of a pneumatic operating cylinder 23, while a second coupling part 24 is arranged on the screwed element 18. In the exemplary embodiment, a pin is used as the first coupling part 21, and in FIG. 2 it is shown rotated into the plane of the drawing. The second coupling part 24 is designed as a claw. The operating cylinder 23 is arranged on a closing cover 25 of a bushing 26 of the mounting 5. A hollow journal 27 on the closing cover 25 has slots 28 which run in the axial direction of the second journal 3 and in which the first coupling part 21 (pin) is guided.

In order to expose the cylinder 1 at the second journal 3, the pneumatic operating cylinder 23 is reversed, (i.e., its piston rod 22 is extended (FIG. 3)). In the process, the claw coupling of the jamming device 20 is coupled in, by the first coupling part 21 entering the second coupling part 24. Since the first coupling part 21 is non-rotatably guided in the slots 28, when it enters the second coupling part 24, it jams the screwed element 18 so that it cannot rotate. If the cylinder 1 is now driven in the direction R1 (FIG. 4) by means of the motor 8, the extension 19 rotates with respect to the stationary screwed element 18, causing it to be unscrewed from the extension 19. As this happens, the piston rod 22 retracts to the extent by which the screwed element 18 is unscrewed from the extension 19 counter to the pressure of the compressed air. After the screwed element 18 has been completely unscrewed from the extension 19, the pneumatic operating cylinder 23 is reversed and assumes the position shown in FIG. 4. At the same time, a spring 29 supported on the screwed element 18 guides the screwed element 18 with it and pulls it away from the cylinder 1. The spring 29 is supported, with respect to the screwed element 18, by an axial bearing 30, such that when the screwed element 18 is stationary and the second journal 3 is rotating, the spring 29 is neither wound up nor jammed.

After the screwed element has been unscrewed from the cylinder 1, the second journal 3, together with its mounting 5 and the portion 9 of the wall, can be pivoted into the position shown dash-dotted in FIG. 1. In the process, an opening 31 which is greater than the diameter D of the cylinder 1 is exposed in the side wall 7. It is now possible for a sleeve 32 belonging to the cylinder 1 to be pushed off the cylinder 1 and removed from the printing machine through the opening 31. The sleeve 32 may be, for example, a printing plate of a plate cylinder or a rubber-blanket sleeve of a transfer cylinder. The removed sleeve 32' is illustrated dash-dotted. It is also possible to remove the entire body 10 of the cylinder 1 from the printing machine through the opening 31. The pivoting action provides a great deal of space for a sleeve or cylinder changes of this type. If the body 10 is screwed to the first journal 2 by means of the screws 13, journal 2 must be loosened beforehand. As has already been indicated, an alternative embodiment, is also possible in which the screws 13 are dispensed with, and the appropriately firmly screwed-in screwed element 18 connects the internal cone 12 to the external cone 11 in a force-transmitting manner via the external and internal cones 16, 17 and the body 10. Moreover, it is also possible for the body 10 of the cylinder 1 to be non-detachably connected to the first journal 2, if changing the body 10 is not intended.

Another body 10 or another sleeve 32 can be brought into the printing machine through the opening 31. The subsequent installation of the second journal 3 is carried out in reverse order to its disassembly. Therefore, first the second journal 3, together with its mounting 5 and the portion 9 of the wall, is folded upwards into the position shown in FIG. 1. A centering means 33, on which the portion 9 of the wall is centered in the correct position, is advantageously provided on the wall 7. The pneumatic operating cylinder 23 is then reversed, causing screwed element 18 to come to rest with its threaded piece on the extension 19. Driving the cylinder 1 in the direction R2 (FIG. 4) by means of the motor 8 now screws the screwed element 18 into the cylinder 1 (into the extension 19), and stresses the second journal 3 against the body 10 and the body 10 against the first journal 2 at the respective conical seats. Here, the torque of the motor 8 is selected such that a force-transmitting connection between the journals 2, 3 and the body 10 is provided. After the screwed element 18 has been screwed in, the motor 8 is switched off and the pneumatic operating cylinder 23 is reversed, so that it assumes the position shown in FIGS. 1 and 2. The cylinder 1 can now fulfil its function. If a number of cylinders in a printing machine are each provided with their own drive motor, the device described can be provided on each of these cylinders, and the ends of these cylinders can be exposed at the same time, by the cylinders being driven at the same time and their jamming devices being activated.

Figure 5:
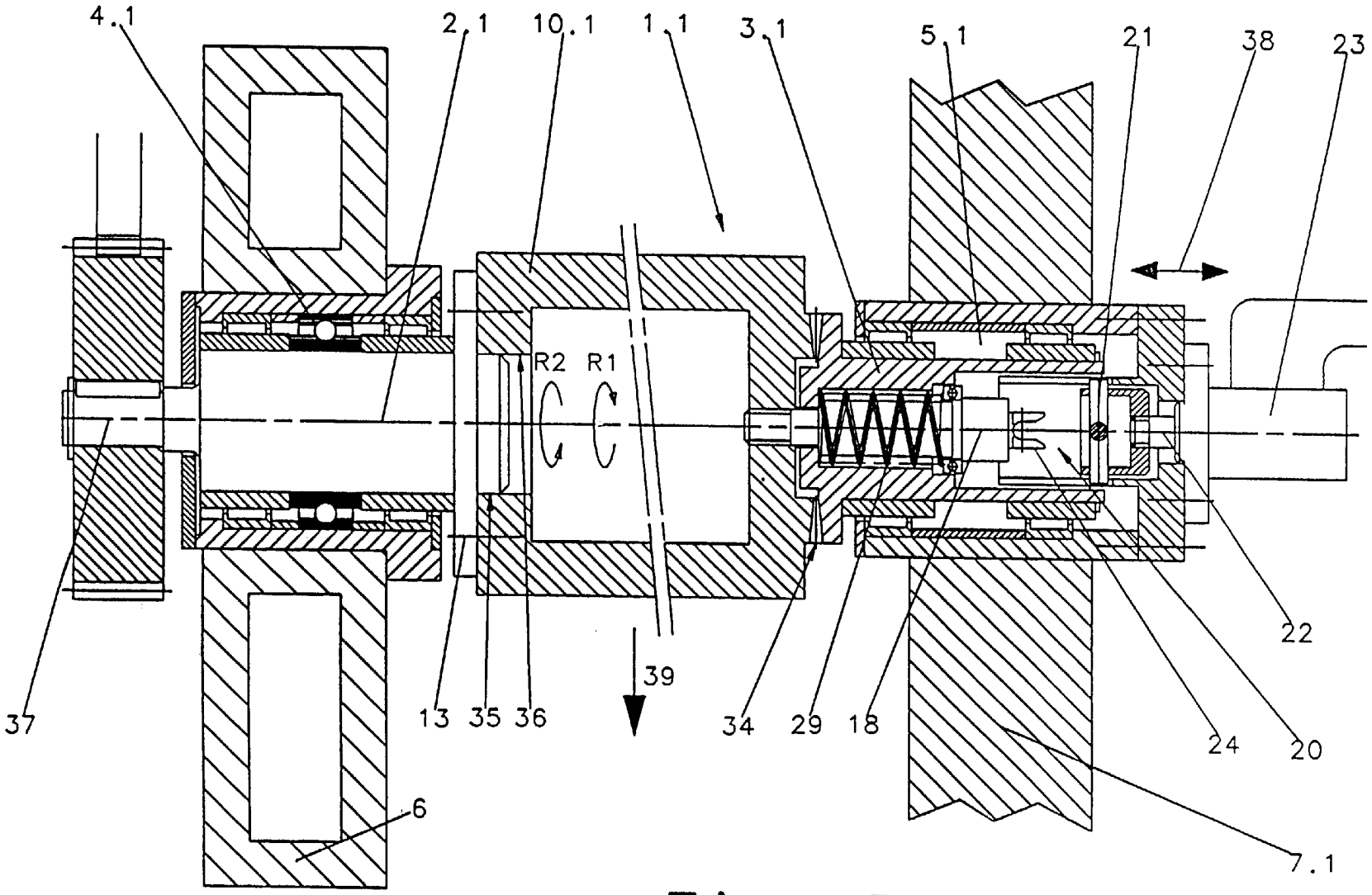
FIG. 5 is a sectional view of a cylinder having a drive by means of a gearwheel and having a movable journal.

FIG. 5 shows a cylinder 1.1 in which the separation point between a second journal 3.1 and a body 10.1 is implemented by means of radial serrations 34. It should be explained that, for the purpose of a simplified description, the reference symbols from the previous exemplary embodiment, if appropriate identified by ".1" to make a distinction, are largely used. The first journal 2.1 is screwed to the body 10.1 of the cylinder 1.1 by means of screws 13. The separation point containing, for example, an external diameter region 35 on the first journal 2.1 and an internal diameter region 76 on the body 10.1. A separation point of this type could also be provided between the body 10.1 and the second journal 3.1 instead of the radial serrations 34, in which case a further protrusion (e.g. as in item 15) should advantageously also be provided. In order to drive the cylinder 1.1, a gearwheel 37 is arranged on its first journal 2.1, having a drive connection to a drive. The gearwheel 37 is designed as a spur gear. Depending on the type of drive, a bevel gear could also be used here. The gearwheel 37 could also be designed as a toothed pulley which is driven by means of a toothed belt. The cylinder 1.1 is mounted with its journals 2.1, 3.1 on both sides in side walls 6, 7.1 by means of mountings 4.1, 5.1. The second journal 3.1 is screwed to the body 10.1 by means of a screwed element 18. Furthermore, there is a jamming device 20 on the second journal 3.1. The screwed element 18 and the jamming device 20 are identical in terms of design to those of the previous exemplary embodiment, for which reason repeated description of the construction is omitted, in order to avoid repetition.

Figure 3:
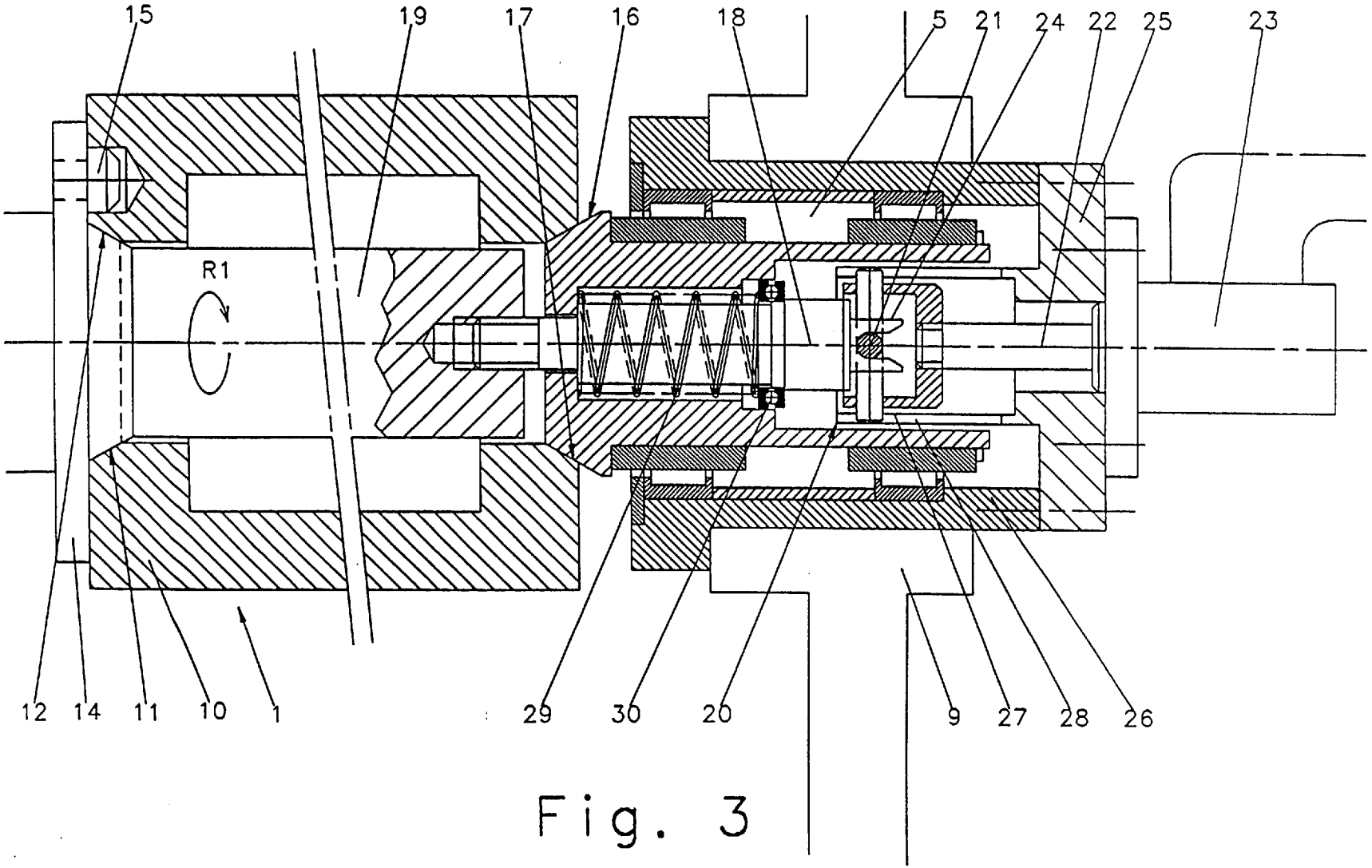
FIG. 3 is a sectional view of the journal shown in FIG. 2 with a jamming device coupled to the screwed element according to an embodiment of the invention.
Figure 4:
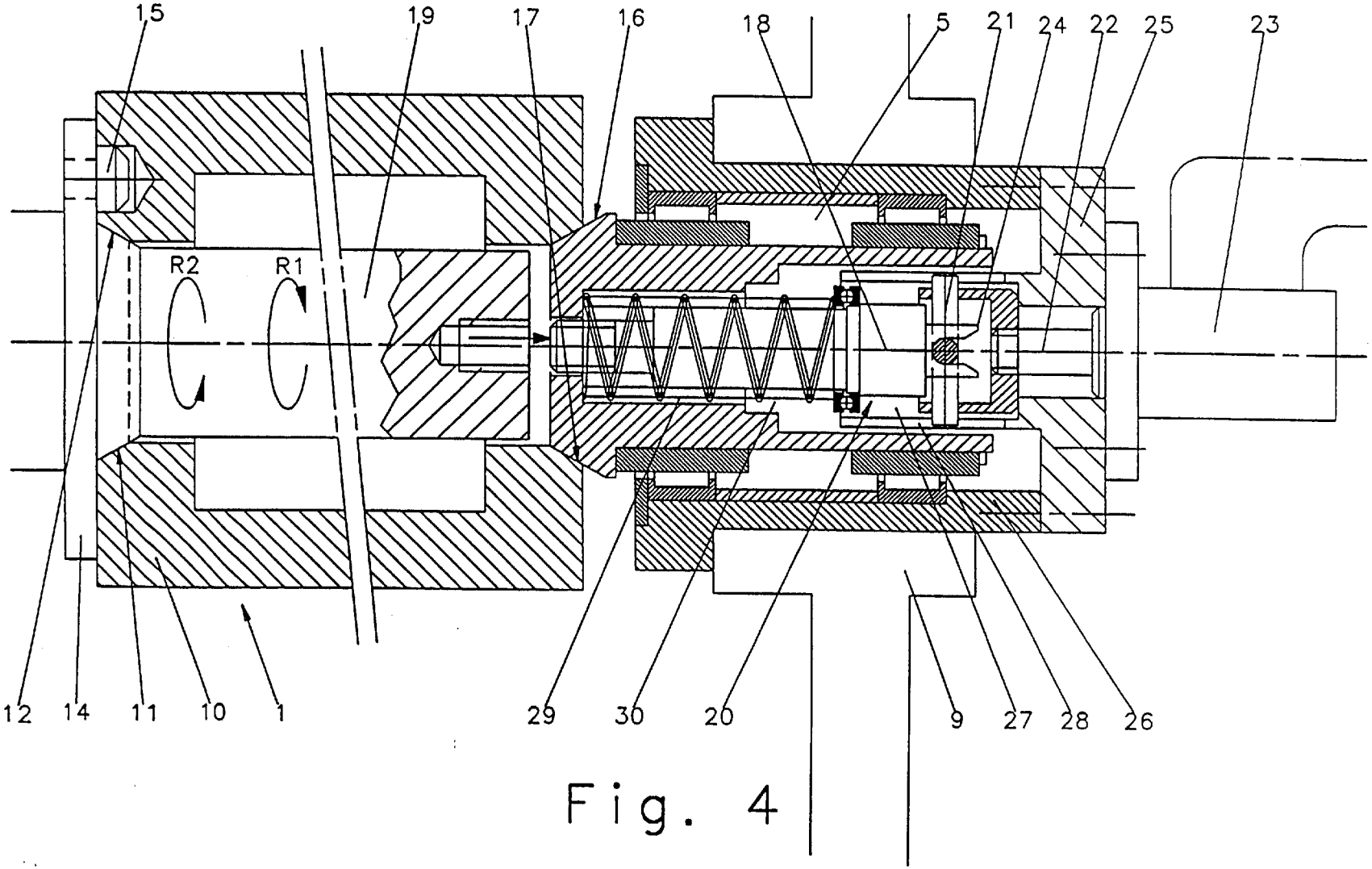
FIG. 4 is a sectional view of the journal shown in FIG. 2 with the screwed element unscrewed from the cylinder in accordance with an embodiment of the invention.

For the purpose of exposing the cylinder 1.1 on the side of its second journal 3.1, that is to say in order to move the second journal 3.1 away, first the pneumatic operating cylinder 23 is reversed. In the process, its piston rod 22 is extended and couples the first coupling part 21 to the second coupling part 24 (as shown in FIG. 3). The cylinder 1.1 is then rotated in the direction R1 by means of the gearwheel 37. The screwed element 18 firmly held by means of the jamming device 20, is thereby unscrewed from the cylinder 1.1 (position of the screwed element 18 as shown in FIG. 4). The second journal 3.1 can then be moved away from the cylinder 1.1, separating the radial serration 34. Together with its mounting 5.1, the second journal 3.1 is displaced to the right in the bore in the side wall 7.1 by means of an actuating device 38. The actuating device 38 is indicated symbolically by means of a double arrow. The body 10.1 exposed on one side, after it has been unscrewed from the first journal 2.1, can be removed in the direction 39 from the frame of the subassembly of the printing machine. Cylinders 1.1 of this type are advantageously used as inking cylinders, pull rolls and others, in which the space needed for replacement is available in the direction 39, that is to say transversely with respect to their longitudinal axis.

The installation of the cylinder 10.1 is carried out in reverse order to its disassembly. Therefore, first the body 10.1 is fixed to the first journal 2.1, then by means of the actuating device 38, the second journal 3.1, together with the mounting 5.1, is moved up to the body 10.1. At the same time, the radial serrations 34 are brought into contact. The subsequent reversal of the pneumatic operating cylinder 23 means that the screwed element 18 is attached to the body 10.1. Driving the cylinder 10.1 in the direction R2 by means of the gearwheel 37 now screws the screwed element 18, held firmly by the blocking device 20, into the body 10.1. Following the reversal of the pneumatic operating cylinder 23, the cylinder 10.1 can be used for its intended operation. It is also possible for a number of cylinders 10.1 having a drive connection to one another via gearwheels to be exposed and installed in the manner described by means of a drive motor (not illustrated). In this case, the exposure or installation should simply be carried out one after another, that is to say the jamming devices 20 of the individual cylinders 1.1 are activated one after another. As a result, the predefined torque for driving the cylinders in the directions R1 and R2 is advantageously in each case individually completely effective for each cylinder 10.1.

The invention is not limited by the embodiments described above which are presented as examples only but can be modified in various ways within the scope of protection defined by the appended patent claims.

We claim:

1. A cylinder for a rotary printing machine mounted with journals in opposing side walls of the printing machine comprising:

a cylindrical body having a longitudinal axis and first and second ends;

first and second journals projecting from the first and second ends of the cylindrical body;

a drive acting on the first journal;

a structural unit preventing exposure of the cylinder on a side of the second journal and being connected to the cylinder;

a screw element capable of being screwed into the cylinder and for connecting the structural unit to the cylinder at a separation point at which the cylindrical body abuts the second journal; and a jamming device connected to the screw element and being adapted for moving between a coupled position and an uncoupled position, wherein the screw element is prevented from rotating with the cylindrical body when the jamming device is in the coupled position, thereby causing movement of the screw element along the longitudinal axis during rotation of the cylindrical body via the drive.

2. The cylinder in accordance with claim 1, wherein the second journal is movable away from the cylindrical body of said cylinder when the screw element is unscrewed from the cylindrical body.

3. The cylinder in accordance with claim 1, wherein said structural unit comprises a wall portion pivotally connectable to a side wall of the printing machine for movement between an open position and a closed position and a mounting for mounting the second journal and the wall portion in the side wall of the printing machine in the closed position, the wall portion, mounting, and second journal exposing an opening on the side wall having a diameter larger than a diameter of the cylinder when the wall portion is in the open position.

4. The cylinder in accordance with claim 1, further comprising a pneumatic operating cylinder having a piston rod, said jamming device further comprises a claw coupling having a first non-rotatable coupling part fixed to said piston rod, said screwed element having a second coupling part, said claw coupling being coupled to said second coupling part by said pneumatic operating cylinder.

5. The cylinder in accordance with claim 1, wherein the drive comprises an electric motor arranged on the first journal.

6. The cylinder in accordance with claim 1, further comprising a gearwheel arranged on the first journal and having a drive connection connected to said drive.

7. The cylinder in accordance with claim 1, wherein said separation point comprises a pair of cones having an external cone arranged on the cylinder body and an internal cone arranged on the unit.

8. The cylinder in accordance with claim 1, wherein a plurality of radial serrations are arranged on said cylindrical body and the structural unit at the separation point.

9. The cylinder in accordance with claim 1, wherein a fit comprising an external diameter region arranged on the cylinder and an internal diameter region arranged on the structural unit is arranged at the separation point.

10. The cylinder in accordance with claim 1, wherein the cylindrical body is detachably connected to the first journal.

11. The cylinder in accordance with claim 1, further comprising:

a mounting for mounting the second journal in a side wall of the printing machine, said side wall having an associated portion; and an opening exposed in the side wall and formed by the moving of said mounting and said associate wall portion away from the cylinder, said opening being larger than a diameter of the cylinder.

* * * * *